US007964328B2

(12) United States Patent
Ferrar et al.

(10) Patent No.: US 7,964,328 B2
(45) Date of Patent: Jun. 21, 2011

(54) CONDENSATION POLYMER PHOTOCONDUCTIVE ELEMENTS

(75) Inventors: Wayne T. Ferrar, Fairport, NY (US); Xin Jin, Pittsford, NY (US); David S. Weiss, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 866 days.

(21) Appl. No.: 11/829,984

(22) Filed: Jul. 30, 2007

(65) Prior Publication Data

US 2009/0035677 A1 Feb. 5, 2009

(51) Int. Cl.
*G03G 5/047* (2006.01)

(52) U.S. Cl. ..... 430/64; 430/56; 430/60; 430/62; 430/123.4; 430/123.43

(58) Field of Classification Search ..... 430/56, 430/60, 64, 62, 123.4, 123.43
See application file for complete search history.

(56) References Cited

U.S. PATENT DOCUMENTS

| | | | | |
|---|---|---|---|---|
| 3,428,451 | A | 2/1969 | Trevoy | |
| 4,082,551 | A | 4/1978 | Steklenski et al. | |
| 4,769,304 | A * | 9/1988 | Kondo et al. | 430/96 |
| 4,971,873 | A | 11/1990 | Pavlisko et al. | |
| 5,128,226 | A | 7/1992 | Hung | |
| 5,681,677 | A | 10/1997 | Bugner et al. | |
| 6,287,737 | B1 | 9/2001 | Ong et al. | |
| 6,294,301 | B1 | 9/2001 | Sorriero et al. | |
| 6,451,956 | B2 | 9/2002 | Sorriero et al. | |
| 6,495,300 | B1 | 12/2002 | Qi et al. | |
| 6,593,046 | B2 | 7/2003 | Sorriero et al. | |
| 6,866,977 | B2 | 3/2005 | Sorriero et al. | |
| 6,946,226 | B2 | 9/2005 | Wu et al. | |
| 2006/0008720 | A1 | 1/2006 | Molaire et al. | |
| 2007/0026332 | A1 | 2/2007 | Ferrar et al. | |
| 2007/0042282 | A1 * | 2/2007 | Molaire et al. | 430/64 |

FOREIGN PATENT DOCUMENTS

| | | |
|---|---|---|
| JP | 2003-327587 | 11/2003 |
| JP | 2003-330209 | 11/2003 |

* cited by examiner

*Primary Examiner* — Christopher RoDee
*Assistant Examiner* — Peter L Vajda
(74) *Attorney, Agent, or Firm* — Carl F. Ruoff; Andrew J. Anderson

(57) ABSTRACT

The present invention relates to photoconductive elements having an electrically conductive support, an electrical barrier layer and, disposed over the conductive layer, a charge generation layer capable of generating positive charge carriers when exposed to actinic radiation. The electrical barrier layer, which restrains injection of positive charge carriers from the conductive support, comprises a crosslinkable condensation polymer having as a repeating unit a planar, electron-deficient, tetracarbonylbisimide group and optionally a crosslinker.

18 Claims, 1 Drawing Sheet

CONDENSATION POLYMER PHOTOCONDUCTIVE ELEMENTS

FIELD OF THE INVENTION

This invention relates to electrophotography. More particularly, it relates to polymers comprising a tetracarbonylbisimide group and to photoconductive elements that contain an electrical charge barrier layer comprised of said polymers.

BACKGROUND OF THE INVENTION

Photoconductive elements useful, for example, in electrophotographic copiers and printers are composed of a conducting support having a photoconductive layer that is insulating in the dark but becomes conductive upon exposure to actinic radiation. To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves in non-irradiated areas a charge pattern known as a latent electrostatic image. The latent image can be developed, either on the surface on which it is formed or on another surface to which it is transferred, by application of a liquid or dry developer containing finely divided charged toner particles.

Photoconductive elements can comprise single or multiple active layers. Those with multiple active layers (also called multi-active elements) have at least one charge-generation layer and at least one n-type or p-type charge-transport layer. Under actinic radiation, the charge-generation layer generates mobile charge carriers and the charge-transport layer facilitates migration of the charge carriers to the surface of the element, where they dissipate the uniform electrostatic charge and form the latent electrostatic image.

Also useful in photoconductive elements are charge barrier layers, which are formed between the conductive layer and the charge generation layer to restrict undesired injection of charge carriers from the conductive layer. Various polymers are known for use in barrier layers of photoconductive elements. For example, Hung, U.S. Pat. No. 5,128,226, discloses a photoconductor element having an n-type charge transport layer and a barrier layer, the latter comprising a particular vinyl copolymer. Steklenski, et al. U.S. Pat. No. 4,082,551, refers to Trevoy U.S. Pat. No. 3,428,451, as disclosing a two-layer system that includes cellulose nitrate as an electrical barrier. Bugner et al. U.S. Pat. No. 5,681,677, discloses photoconductive elements having a barrier layer comprising certain polyester ionomers. Pavlisko et al, U.S. Pat. No. 4,971,873, discloses solvent-soluble polyimides as polymeric binders for photoconductor element layers, including charge transport layers and barrier layers.

Still further, a number of known barrier layer materials function satisfactorily only when coated in thin layers. As a consequence, irregularities in the coating surface, such as bumps or skips, can alter the electric field across the surface. This in turn can cause irregularities in the quality of images produced with the photoconductive element. One such image defect is caused by dielectric breakdowns due to film surface irregularities and/or non-uniform thickness. This defect is observed as toner density in areas where development should not occur, also known as breakdown.

The known barrier layer materials have certain drawbacks, especially when used with negatively charged elements having p-type charge transport layers. Such elements are referred to as p-type photoconductors. Thus, a negative surface charge on the photoconductive element requires the barrier material to provide a high-energy barrier to the injection of positive charges (also known as holes) and to transport electrons under an applied electric field. Many known barrier layer materials are not sufficiently resistant to the injection of positive charges from the conductive support of the photoconductive element. Also, for many known barrier materials the mechanism of charge transport is ionic. This property allows for a relatively thick barrier layer for previously known barrier materials, and provides acceptable electrical properties at moderate to high relative humidity (RH) levels. Ambient humidity affects the water content of the barrier material and, hence, its ionic charge transport mechanism. Thus, at low RH levels the ability to transport charge in such materials decreases and negatively impacts film electrical properties. A need exists for charge barrier materials that transport charge by electronic as well as ionic mechanisms so that films are not substantially affected by humidity changes.

Condensation polymers of polyester-co-imides, polyesterionomer-co-imides, and polyamide-co-inmides are all addressed in:

1. Sorriero et al. in U.S. Pat. No. 6,294,301.
2. Sorriero et al. in U.S. Pat. No. 6,451,956.
3. Sorriero et al. in U.S. Pat. No. 6,593,046.
4. Sorriero et al. in U.S. Pat. No. 6,866,977.
5. Molaire et al. in US Patent Publication No. 20060008720
6. Molaire et al. in US Patent Publication No. 20070042282.

These polymers have as a repeating unit a planar, electron-deficient, tetracarbonylbisimide group that is in the polymer backbone. The polymers are either soluble in chlorinated solvents and chlorinated solvent-alcohol combinations, or they contain salts to achieve solubility in polar solvents. In all cases, care must be taken not to disrupt the layer with subsequent layers that are coated from solvents, as this may result in swelling of the electron transport layer, mixing with the layer, or dissolution of part or all of the polymer. Furthermore, salts can make the layer subject to unwanted ionic transport.

Japanese Kokai Tokkyo Koho 2003330209A to Canon includes polymerizable naphthalene bisimides among a number of polymerizable electron transport molecules. Some of the naphthalene bisimides contain acrylate functional groups, epoxy groups, and hydroxyl groups. The monomers are polymerized after they are coated onto an electrically conductive substrate. However this approach does not ensure the full incorporation of all of the monomers. Some of the functional groups would not react to form a film and could thus be extracted during the deposition of subsequent layers. This would result in a layer that was not the same composition as deposited before polymerization. Further, it would allow for the unwanted incorporation of the electron transport agent into the upper layers of the photoreceptor by contamination of the coating solutions. Thus the need remains for a well-characterized electron transport polymer that can be coated and crosslinked completely to produce a layer that will transport electrons between layers of a photoreceptor without contaminating subsequent layers.

Japanese Kokai Tokkyo Koho 2003327587A to Canon describes the synthesis of naphthalene bisimide acrylate polymers. The polymers were coated from solution onto "aluminum Mylar" and irradiated with an electron beam to harden the layer to form crack free films. Mobility measurements were made. The need exists to form an insoluble film from a polymer that can transport electrons and has active sites for crosslinking that result in a film that can be overcoated with subsequent layers to form a photoreceptor. The crosslinking should be done either thermally or with UV light.

Organic electron transport agents have been attached to inorganic particles in U.S. Pat. No. 6,946,226 B2 to Wu. The purpose is to make thick hole blocking layers for photoreceptors. Attachment to the particle prevents structural damage upon coating of a subsequent photogenerating layer.

Crosslinkable polymers containing electron transport moieties are disclosed in U.S. Pat. Nos. 6,287,737 and 6,495,300. The polymers contain hydrolysable silane side groups and hydroxyl groups. The crosslinked polymeric layers are useful as hole blocking layers in photoconductive imaging members.

Crosslinkable vinyl polymers as barrier layers for photoreceptors are disclosed in US Patent Publication No. 2007/0026332. The barrier layer includes a vinyl polymer with aromatic tetracarbonylbisimide side groups and crosslinking sites.

Photoconductive elements typically are multi-layered structures wherein each layer, when it is coated or otherwise formed on a substrate, needs to have structural integrity and desirably a capacity to resist attack when a subsequent layer is coated on top of it or otherwise formed thereon. Such layers are typically solvent coated using a solution with a desired coating material dissolved or dispersed therein. This method requires that each layer of the element, as such layer is formed, should be capable of resisting attack by the coating solvent employed in the next coating step. A need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer is substantially impervious to, or insoluble in, solvents used for coating other layers, e.g., charge generation layers, over the barrier layer.

Accordingly, a need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer is substantially impervious to, or insoluble in, solvents used for coating other layers, e.g., charge generation layers, over the barrier layer.

Photoconductive elements comprising a photoconductive layer formed on a conductive support such as a film, belt or drum, with or without other layers such as a barrier layer, are also referred to herein, for brevity, as photoconductors.

PROBLEM TO BE SOLVED BY THE INVENTION

A need exists for a negatively chargeable photoconductive element having a p-type photoconductor, and including an electrical barrier layer that can be coated from an aqueous or organic medium, that is crosslinked rapidly under mild conditions, that has good resistance to the injection of positive charges, can be sufficiently thick and uniform that minor surface irregularities do not substantially alter the field strength, and resists hole injection and transport over a wide humidity range. Still further, a need exists for photoconductive elements wherein the barrier layer is substantially impervious to, or insoluble in, solvents used for coating other layers, e.g., charge generation layers, over the barrier layer.

SUMMARY OF THE INVENTION

The present invention relates to a photoconductive element comprising an electrically conductive support, an electrical barrier layer disposed over said electrically conductive support, and disposed over said barrier layer, a charge generation layer capable of generating positive charge carriers when exposed to actinic radiation, said barrier layer comprising condensation polymer with aromatic tetracarbonylbisimide groups and crosslinking sites.

The crosslinkable condensation polymer has covalently bonded as repeating units in the polymer chain, aromatic tetracarbonylbisimide groups of the formula:

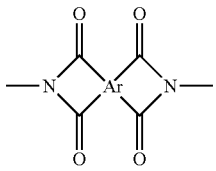

wherein Ar represents a tetravalent aromatic group.

More specifically, the barrier layer polymer is a polyester-co-imide that contains an aromatic tetracarbonylbisimide group and has the formula:

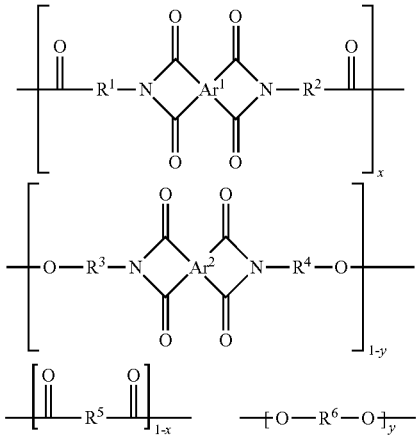

where x=mole fraction of tetracarbonylbisimide diacid residue in the diacid component of the monomer feed from 0-1 and 1−y=mole fraction of tetracarbonylbisimide glycol residue in the glycol component of the monomer feed from 0-1 such that x+(1−y)=0.1 to 1.9.

$Ar^1$ and $Ar^2$=a tetravalent aromatic group having from 6 to 20 carbon atoms and may be the same or different. Representative groups include:

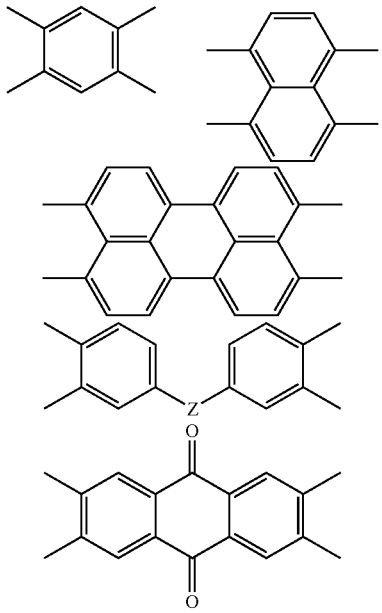

where Z=

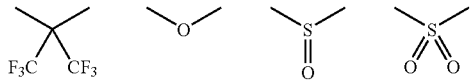

$R^1$, $R^2$, $R^3$, and $R^4$=alkylene and may be the same or different. Representative alkylene moieties include 1,3-propylene, 1,5-pentanediyl and 1,10-decanediyl.

$R^5$=alkylene or arylene. Representative moieties include 1,4-cyclohexylene, 1,2-propylene, 1,4-phenylene, 1,3-phenylene, 5-t-butyl-1,3-phenylene, 2,6-naphthalene, vinylene, 1,1,3-trimethyl-3-(4-phenylene)-5-indanyl, 1,12-dodecanediyl, and the like.

$R^6$=alkylene such as ethylene, 2,2-dimethyl-1,3-propylene, 1,2-propylene, 1,3-propylene, 1,4-butanediyl, 1,6-hexanediyl, 1,10-decanediyl, 1,4-cyclohexanedimethylene, 2,2'-oxydiethylene, polyoxyethylene, tetraoxyethylene, and the like, or hydroxyl substituted alkylene such as 2-hydroxymethyl-1,3-propanediyl, 2-hydroxymethyl-2-ethyl-1,3-propanediyl, 2,2-bis(hydroxymethyl)-1,3-propanediyl, and the like.

ADVANTAGEOUS EFFECT OF THE INVENTION

The invention provides for a negatively chargeable photoconductive element having a p-type photoconductor, and including an electrical barrier polymer that has good resistance to the injection of positive charges, can be sufficiently thick and uniform that minor surface irregularities do not substantially alter the field strength, and resists hole transport over a wide humidity range. The barrier polymer is prepared from a condensation polymer having pendent planar, electron-deficient, tetracarbonylbisimide groups that are crosslinked with UV radiation. This barrier polymer is substantially impervious to, or insoluble in, solvents used for coating other layers, e.g., charge generation layers, over the barrier polymer layer.

DETAILED DESCRIPTION OF THE INVENTION

Figure 1:
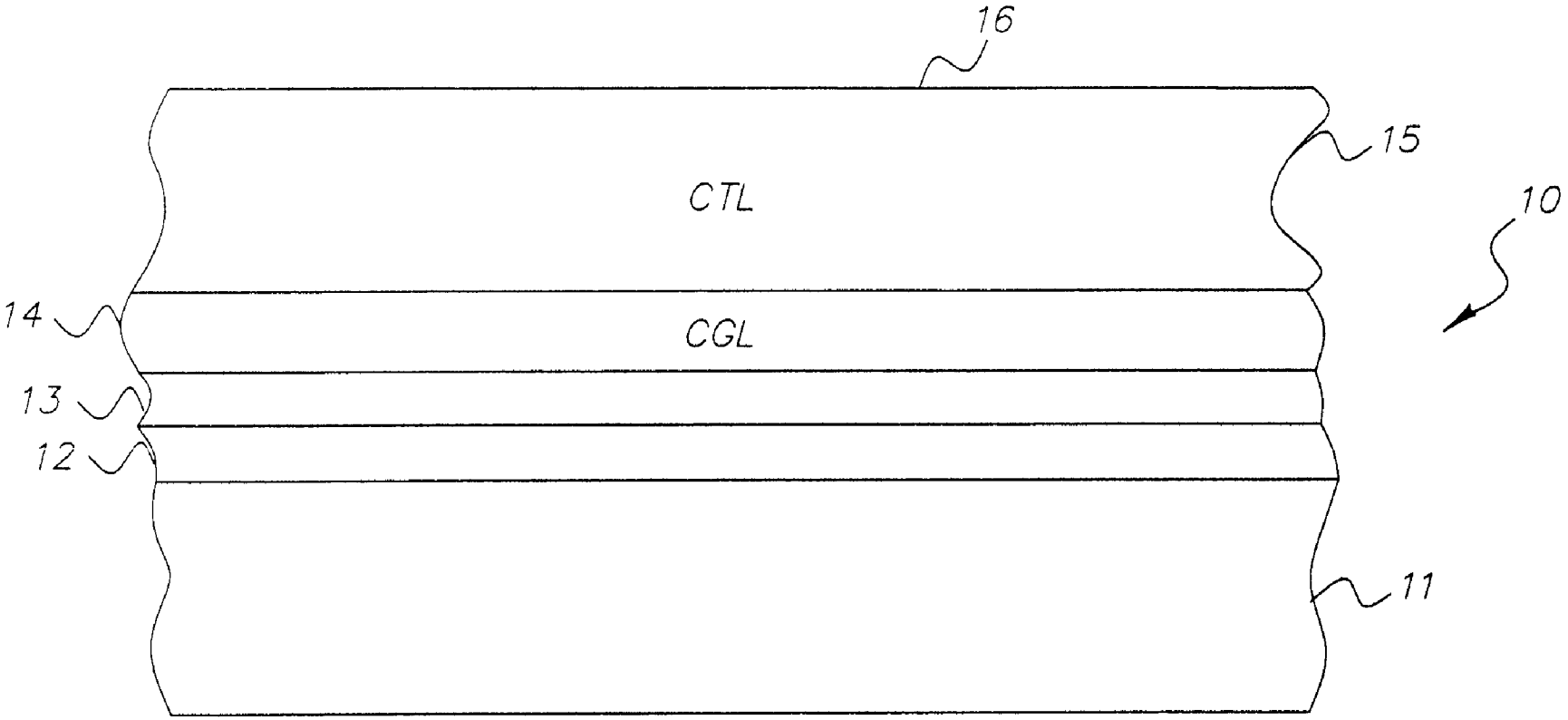
FIG. 1 is a schematic cross section, not to scale, for one embodiment of a photoconductive element according to the invention.

The invention has numerous advantages. As illustrated in FIG. 1, the invention provides an embodiment of a photoconductive element 10 of the invention comprises a flexible polymeric film support 11. On this support is coated an electrically conductive layer 12. Over the conductive layer 12 is coated a polymeric barrier layer 13, the composition of which is indicated above and described more fully hereinafter. Over the barrier layer 13 is coated a charge generation layer 14, and over the latter is coated a p-type charge transport layer 15. The p-type charge transport layer 15 is capable of transporting positive charge carriers generated by charge generation layer 14 in order to dissipate negative charges on the surface 16 of the photoconductive element 10.

The barrier and other layers of the photoconductive element are coated on an "electrically-conductive support," by which is meant either a support material that is electrically-conductive itself or a support material comprising a non-conductive substrate, such as support 11 of the drawing, on which is coated a conductive layer 12, such as vacuum deposited or electroplated metals, such as nickel. The support can be an electrically conductive metal such as aluminum. The support can be fabricated in any suitable configuration, for example, as a sheet, a drum, or an endless belt. Examples of "electrically-conductive supports" are described in Bugner et al, U.S. Pat. No. 5,681,677, the teachings of which are incorporated herein by reference in their entirety.

The barrier layer composition can be applied to the electrically conductive substrate by coating the substrate with an aqueous dispersion or solution of the barrier layer polymer using, for example, well known coating techniques, such as knife coating, dip coating, spray coating, swirl coating, extrusion hopper coating, or the like. In addition to water, other solvents which are suitable are polar solvents, such as alcohols, like methanol, ethanol, propanol, isopropanol, and mixtures thereof. As indicated in the examples hereinafter, such polar solvents can also include ketones, such as acetone, methylethylketone, methyl isobutyl ketone, or mixtures thereof. After application to the conductive support, the so-coated substrate can be air dried. It should be understood, however, that, if desired, the barrier layer polymers can be coated as solutions or dispersions in organic solvents, or mixtures of such organic solvents and water, by solution coating techniques known in the art.

Typical solvents for solvent coating a photoconductive charge generation layer over a charge barrier layer are disclosed, for example, in Bugner et al., U.S. Pat. No. 5,681,677; Molaire et al., U.S. Pat. No. 5,733,695; and Molaire et al., U.S. Pat. No. 5,614,342; the teachings of which are all incorporated herein by reference in their entirety. As these references indicate, the photoconductive material, e.g., a photoconductive pigment, is solvent coated by dispersing it in a binder polymer solution. Commonly used solvents for this purpose include chlorinated hydrocarbons, such as dichloromethane, as well as ketones and tetrahydrofuran. A problem with known barrier layer compositions is that such solvents for the coating of the photoconductive or charge generation layer will also dissolve or damage the barrier layer. An advantage of the barrier layer compositions of the invention is crosslinking sites are incorporated into the polymer. Because the barriers are crosslinked, they are not substantially dissolved or damaged by chlorinated hydrocarbons or the other commonly used solvents for coating photoconductor or charge generation layers, at the temperatures and for the time periods employed for coating such layers. This is achieved by using the end groups of the polymer to react with crosslinking agents, or through copolymerization with difunctional monomers that incorporate the functional groups that are available for reaction with a crosslinking agent. The crosslinked polymers are not substantially dissolved or damaged by chlorinated hydrocarbons or the other commonly used solvents for coating photoconductor or charge generation layers, at the temperatures and for the time periods employed for coating such layers.

There are many commercial crosslinking agents that will react when heated for a sufficient period of time with an active functional group of a polymer to form crosslinked networks. UV curing operates via electronic excitation and is considered non-thermal curing. The reaction times are generally short and the temperatures less harsh. The WILEY/SITA Series Chemistry and Technology for Coatings, Inks, Paints is a good reference of UV Curing. Volume II entitled Prepolymers & Reactive Diluents, G. Webster, Edt., relates to the crosslinking of the electro deficient bisimide polyesters of this invention. Acryloyl chloride was used in this invention of incorporate the acylic monomer into the polyester by reaction with the hydroxy end group in the presence of triethylamine, although acrylic acid is generally used for the preparation of commodity polyester acrylates. This acryloyl chloride pathway was used because the polymer derivatization is more efficient and the product more easily purified. Multifunctional acrylates were used as the crosslinking agents and are available commercially from Sartomer Company, Inc., Exton, Pa. Photoinitiators such as IRGACURE are also useful for the preparation of the crosslinked layers.

There are hundreds of UV crosslinkers and photointitiators commercially available. We chose several chemical agents as following for our formulation study based on our expectation and understanding of the electron transport mechanism but it will be understood that variations and modifications can be effected within the spirit and scope of the invention.

Crosslinkers (multi-functional acrylate, from Sartomer Company, Inc.):

CN968: an aliphatic polyester based urethane hexaacrylate oligomer. It has fast curing rate, low viscosity, good abrasion and heat resistance.

SR399: dipentaerythritol pentaacrylate

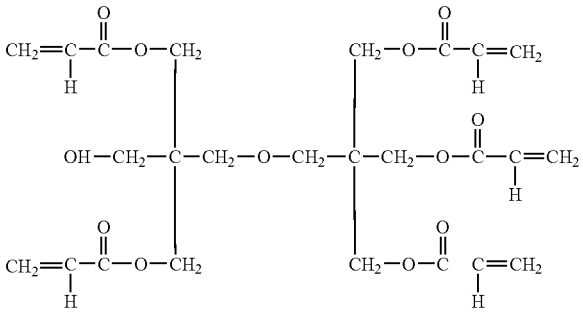

SR492: propoxylated (3) trimethylolpropane triacrylate

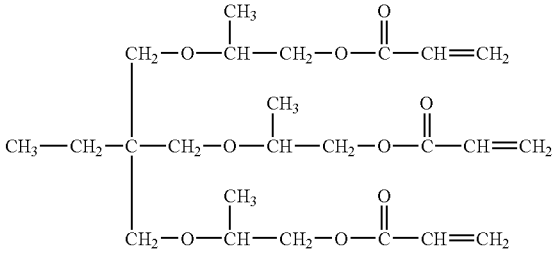

Photoinitiators (from Sartomer Company, Inc. and Ciba Specialty Chemicals, Tarrytown, N.Y.):

Esacure One: a solid with alpha-hydroxy ketone groups.

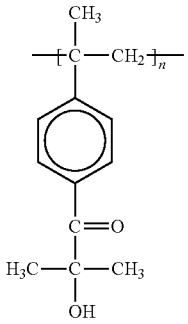

wherein n is 1 or greater.

SR1122 (IRGACURE 184): 1-hydroxycyclohexyl phenyl ketone

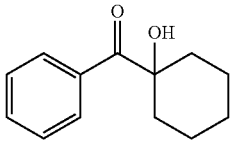

SR1130: oligo[2-hydroxy-2-methyl-1-[4-(1-methylvinyl) phenyl]propanone] and 2-hydroxy-2-methyl-1-phenyl1-propanone (polymeric hydroxy ketone)

SR1137: Blend of trimethylbenzophenone and methylbenzophenone

SR1135: Blend of phosphine oxide, Sarcure SR1130 and Sarcure SR1137

IRGACURE 369: 2-benzyl-2-(dimethylamino)-4'-morpholino butyrophenone

The advantage of crosslinking the polyester-co-imide is that the cured polymer is insoluble in all solvents. Thus the polymer can be overcoated with any solvent system, without regard to the solubility of any subsequent layers of coating. This is a substantial advantage over previous bisimide polymers prepared by condensation polymerization, where the subsequent layers had to be coated from solvents that would not dissolve the barrier layer. Additionally, intermixing of the barrier layer with other layers can be minimized or eliminated by controlling the degree of crosslinking in the barrier layer. For example, certain polyamides of the barrier layer polymers of the prior art were dissolved in mixtures of dichloromethane with a polar solvent such as methanol or ethanol. The polyamide barrier layers were "substantially insoluble" in chlorinated hydrocarbons and could be overcoated with solvents such as dichloromethane. However, that solvent could not also contain an alcohol as that would render the imide containing polyamide soluble and results in dissolution of the layer. The barrier layer polymers of the present invention are not limited by this restriction and can be overcoated with a wide variety of solvents, including the same solvent as the polymer was originally coated from. The examples could be coated from THF, cured, and overcoated with a THF solution of another polymer to deposit a layer such as a charge generation layer on the barrier layer. In a similar manner, the polyesterionomers-co-imides of the prior art employ polar solvents to deposit the electron transport barrier layer onto the substrate. Overcoating with subsequent layers is then limited to solvents that will not destroy the polymer or cause mixing with subsequent layers, and thus only non-polar solvents can be used to coat the subsequent layers. This can be a disadvantage as it limits the choice of compounds that can be overcoated onto the barrier layer. It also necessitates the use of organic solvents that are often not as environmentally desirable as polar solvents such as alcohols and water. Thus the crosslinked polyester-co-imides allow for a broader choice of coating solvents in the formulations of the photoreceptors.

The compositions of, the locations, and methods for forming the photoconductive charge generating layer, the charge transport layer, and other components of the photoconductive element of the invention are as described in Bugner et al. U.S. Pat. No. 5,681,677 cited above and incorporated herein by reference in its entirety.

A preferred conductive support for use in electrophotographic and laser copiers or printers is a seamless, flexible cylinder or belt of polymer material on which nickel can be electroplated or vacuum deposited. Other useful supports include belts or cylinders with layers of other metals, such as stainless steel or copper, deposited thereon. Such conductive supports have important advantages, but at least one drawback for which the barrier layer compositions of the present invention, and particularly certain preferred polyester-co-imide as described more fully hereinafter, provide a solution. The deposited nickel layers often have bumps or other irregularities which, when the barrier layer is thin, can cause an irregular electric field strength across the surface and thus cause defects, electrical breakdown, or so-called black spots in the resulting image. Thus, irregularities on the electrically conductive support make it desirable to have a barrier layer which can be coated at thicknesses which are adequate to smooth out this surface roughness. As an advantage over conventional barrier materials, the barrier materials of the present invention can be formed in relatively thick layers and still have desired electrophotographic properties. As a relatively thick layer, e.g., greater than 1 micron and, in more preferred embodiments, greater than 1.2 microns, preferably greater than about 2 microns, more preferably greater than about 3 microns, and most preferably greater than about 4 microns, the barrier layer of the invention can act as a smoothing layer and compensate for such surface irregularities. In particular, the preferred polyester-co-imides described below can be coated as a relatively thick barrier layer, in comparison to those elements in the prior art with good performance in an electrophotographic film element.

The barrier layer polymer employed is a condensation polymer that contains as a repeating unit a planar, electron-deficient aromatic tetracarbonylbisimide group as defined above.

The barrier layer polymer is a polyester-co-imide that contains an aromatic tetracarbonylbisimide group and has the formula:

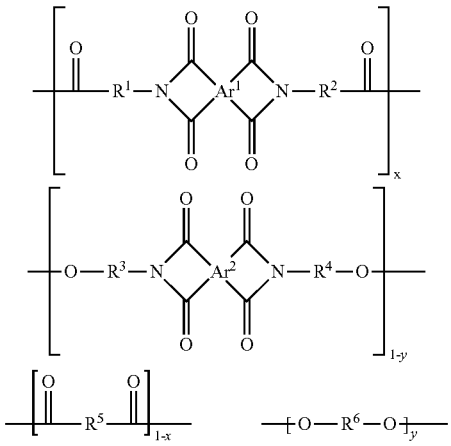

where x=mole fraction of tetracarbonylbisimide diacid residue in the diacid component of the monomer feed from 0-1 and 1−y=mole fraction of tetracarbonylbisimide glycol residue in the glycol component of the monomer feed from 0-1 such that x+(1−y)=0.1 to 1.9.

$Ar^1$ and $Ar^2$=a tetravalent aromatic group having from 6 to 20 carbon atoms and may be the same or different. Representative groups include:

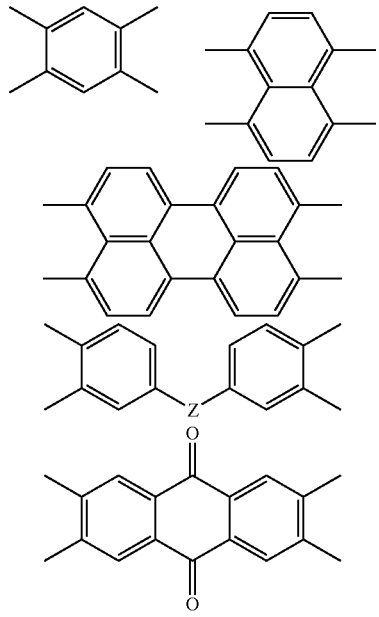

where Z=

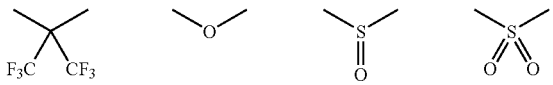

$R^1$, $R^2$, $R^3$, and $R^4$=alkylene and may be the same or different. Representative alkylene moieties include 1,3-propylene, 1,5-pentanediyl and 1,10-decanediyl.

$R^5$=alkylene or arylene. Representative moieties include 1,4-cyclohexylene, 1,2-propylene, 1,4-phenylene, 1,3-phenylene, 5-t-butyl-1,3-phenylene, 2,6-naphthalene, vinylene, 1,1,3-trimethyl-3-(4-phenylene)-5-indanyl, 1,12-dodecanediyl, and the like.

$R^6$=alkylene such as ethylene, 2,2-dimethyl-1,3-propylene, 1,2-propylene, 1,3-propylene, 1,4-butanediyl, 1,6-hexanediyl, 1,10-decanediyl, 1,4-cyclohexanedimethylene, 2,2'-oxydiethylene, polyoxyethylene, tetraoxyethylene, and the like, or hydroxyl substituted alkylene such as 2-hydroxymethyl-1,3-propanediyl, 2-hydroxymethyl-2-ethyl-1,3-propanediyl, 2,2-bis(hydroxymethyl)-1,3-propanediyl, and the like.

The barrier layer polymers in accordance with the present invention thus contain planar, electron-deficient aromatic, functionalized bisimide groups in which the aromatic group is preferably a tri- or tetravalent benzene, perylene, naphthalene or anthraquinone nucleus. In addition to the carbonyl groups, aromatic groups in the foregoing structural formulas can have other substituents thereon, such as $C_{1-6}$ alkyl, $C_{1-6}$ alkoxy, or halogens. Examples of useful imide structures include 1,2,4,5-benzenetetracarboxylic-bisimides:

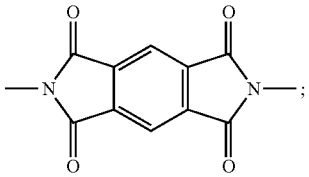

1,4,5,8-naphthalenetetracarboxylic-bisimides:

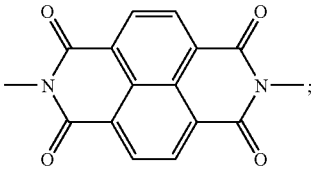

3,4,9,10-perylenetetracarboxylic-bisimides:

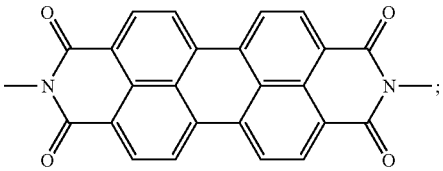

2,3,6,7-anthraquinonetetracarboxylic-bisimides:

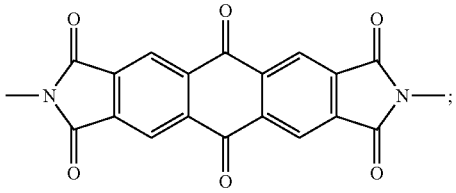

and hexafluoroisopropylidene-2,2',3,3'-benzenetetracarboxylic-bisimides

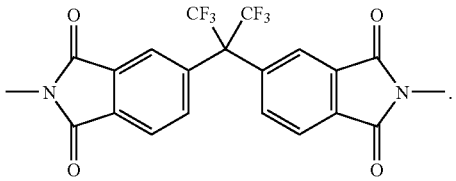

Especially preferred are those with a fused ring system, such as naphthalenetetracarbonylbisimides and perylenetetracarbonylbisimides, as in many instances they are believed to transport electrons more effectively than a single aromatic ring structure. The preparation of such tetracarbonylbisimides is known and described, for example, in U.S. Pat. No. 5,266,429, the teachings of which are incorporated herein by reference in their entirety. These moieties are especially useful when incorporated into polyester-co-imides as the sole electron-deficient moiety or when incorporated into such polymers in various combinations. The mole percent concentration of the electron deficient moiety in the polymer can desirably range from about 5 mol % to 100 mol %, preferably from about 50 mol % to 100 mol %, with a more preferred range being from about 70 mol % to about 80 mol %.

The barrier layer polymers in accordance with the invention are prepared by condensation of at least one diol compound with at least one dicarboxylic acid, ester, anhydride, chloride or mixtures thereof. Such polymers can have a weight-average molecular weight of 1,500 to 250,000. The preferred polymers of this invention are low molecular weight materials with multiple hydroxyl end groups, and are commonly referred to as polyols. The polyester-co-imide polyols of this invention are prepared by melt polymerization using an excess of hydroxyl functional monomer. Because the hydroxyl sites can function as branch points in the polymer, the ratio of the weight average molecular weight to the number average molecular weight is generally greater than 2, the expected ratio for a linear condensation polymer. Thus the number average molecular weights can be as low as 750, but the weight average molecular weight is much higher for the same molecule. Polyester resin calculations to produce these multifunctional materials are available from Eastman Chemical Company in Kingsport, Tenn. and can be obtained on the world wide web at http://www.eastman.com/Wizards/ResinCalculationProgram.

The bisimide structure containing the tetravalent-aromatic nucleus can be incorporated either as a diol or diacid by reaction of the corresponding tetracarbonyldianhydride with the appropriate amino-alcohol or amino-acid. The resulting bisimide-diols or bisimide-diacids may then by polymerized, condensed with diacids or diols, to prepare the barrier layer polymers by techniques well-known in the art, such as interfacial, solution, or melt polycondensation. A preferred technique is melt-phase polycondensation as described by Sorensen and Campbell, in "Preparative Methods of Polymer Chemistry," pp. 113-116 and 62-564, Interscience Publishing, Inc. (1961) New York, N.Y. Preparation of bisimides is also disclosed in U.S. Pat. No. 5,266,429, previously incorporated by reference.

Preferred diacids for preparing the crosslinkable barrier layer polymers include terephthalic acid, isophthalic acid, maleic acid, 2,6-naphthanoic acid, 5-t-butylisophthalic acid, 1,4-cyclohexanedicarboxylic acid, 1,1,3-trimethyl-3-(4-carboxyphenyl)-5-indancarboxylic acid, pyromellitic dianhydride, maleic anhydride, dodecanediodic acid, and methylsuccinic acid.

A polymer structure which incorporates the electron deficient naphthalene bisimide as both the acid and the alcohol is show below as:

A preferred type of monomer is the diacid which comprises a divalent cyclohexyl moiety, such as 1,4-cyclohexanedicarboxylic acid, including both the cis- and trans-isomers thereof. These monomers are commercially available from Eastman Chemical Company, and are as a mixture of both the cis- and trans-isomer forms. This type of aliphatic monomer generally provides more desirable electrical properties, such as lower dark decay levels, relative to other aliphatic monomers. The alicyclic moiety also provides an aliphatic moiety in the resulting polymer that is more resistant to degradation than incorporation of a linear aliphatic chain segment. For example, hydrolysis is less of an issue in a coating solution used for extended period of time if cyclohexane dicarboxylic acid rather than sebacic acid makes up the polymer backbone. This has been described in the literature, Ferrar, W. T., Molaire, M. F., Cowdery, J. R., Sorriero, L. J., Weiss, D. S., Hewitt, J. M. Hewitt; Polym. Prepr, 2004, 45(1), 232-233.

A polymer structure which incorporates the electron deficient naphthalene bisimide only as the glycol is shown below as:

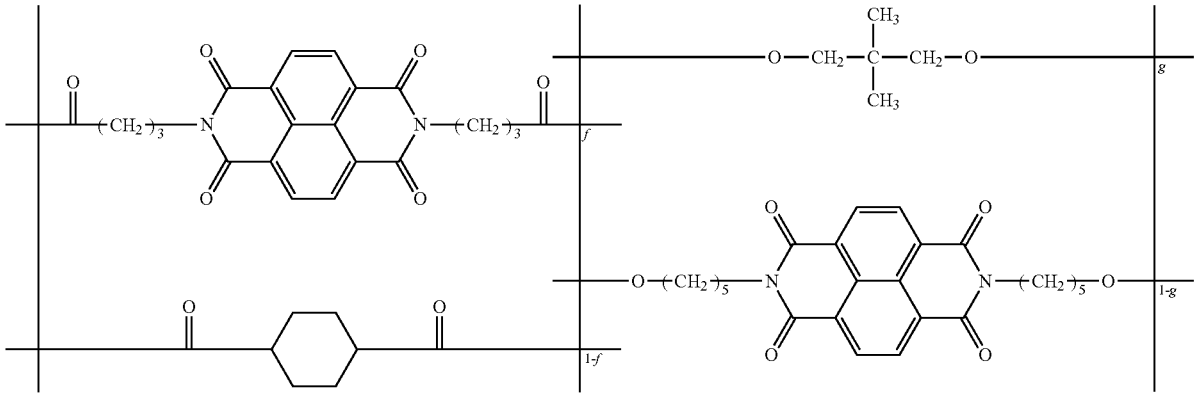

f and g represent mole fractions wherein f is from about 0.05 to 0.9 and g is from 0.05 to about 0.9.

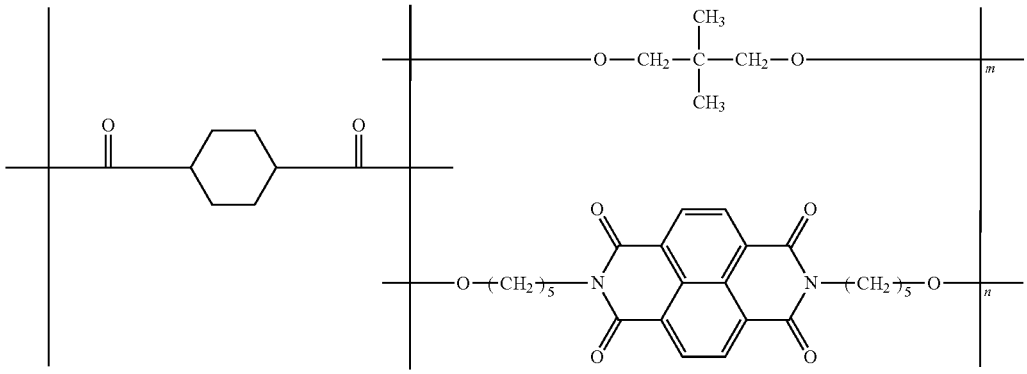

m and n represent mole fractions wherein m is from about 0.1 to 0.9 and n is from 0.1 to about 0.9.

Preferred diols and their equivalents for preparing the barrier layer polymers include ethylene glycol, polyethylene glycols, such as tetraethylene glycol, 1,2-propanediol, 2,2'-oxydiethanol, 1,4-butanediol, 1,6-hexanediol, 1,10-decanediol, 1,4-cyclohexanedimethanol, 2,2-dimethyl-1,3-propanediol and 4,4-isopropylidene-bisphenoxy-ethanol. Other precursors to diols include ethylene carbonate and propylene carbonate.

Although crosslinking can be accomplished though the end groups of the polyester-co-imide, additional crosslinking sites can be incorporated into the polymer through multifunctional monomers. Monomers that contain three and four hydroxyl groups can be introduced during the melt polymerization. These monomers can be used to create branch points in the polymer to change the viscosity characteristics of the polymer. However, the branching can be retarded for the purpose of favoring the functional group incorporation at those positions by making the stoichiometry of the reaction favor the functional group, and by keeping the molecular weight of the polymer low. These differences of branching and functional group incorporation can be readily determined by polymer analysis including size exclusion chromatography and nuclear magnetic resonance (NMR) spectroscopy.

Examples of monomers that are useful for incorporation of crosslinkable acid functional sites into condensation polymers include 1,2,4,5-benzenetetracarboxylic acid (pyromellitic acid), 1,2,4,5-benzenetetracarboxylic dianhydride (pyromellitic dianhydride), 1,2,3-benzenetricarboxylic acid hydrate (hemimellitic acid), 1,2,4-benzenetricarboxylic acid (trimellitic acid), 1,3,5-benzenetricarboxylic acid (trimesic acid), 1,2,4-benzenetricarboxylic anahyride (trimellitic anhydride). Examples of monomers that can be used to incorporate hydroxy functionality into the polymer include trimethylolpropane, trimethylolpropane ethoxylate, trimethylolethane, pentaerythitol, pentaerythitol ethoxylate, pentaerythitol propoxylate, pentaerythitol propoxylate/ethoxylate, and dimethyl-5-hydroxysisophthalate Specific structures that incorporate 1,4-cyclohexanedicarboxylic acid, N,N'-Bis-(5-hydroxypentyl)-1,4,5,8-naphthalenetetracarboxylic diimide, 2,2-dimethyl-1,3-propanediol, and trimethylolpropane into the polyester-co-imide are shown below.

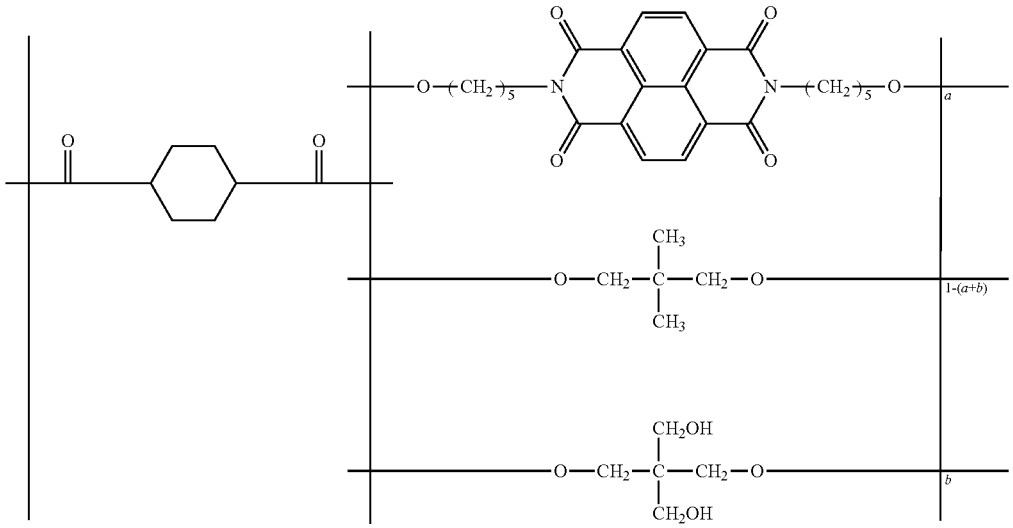

wherein a and b are mole fraction of a group and a represents a value between 0.1 and 0.95 and b represents a value between 0.01 and 0.5. More preferably a represents a value between 0.5 and 0.9 and b represents a value between 0.04 and 0.3.

Another representation of the above polymer where the hydroxy sites have been derivatized with the vinyl, acrylate, or methacrylate groups is shown below.
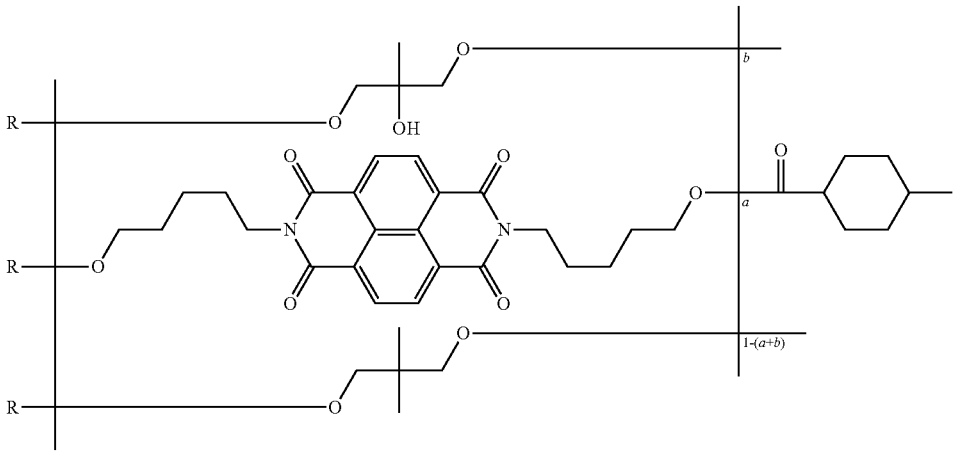
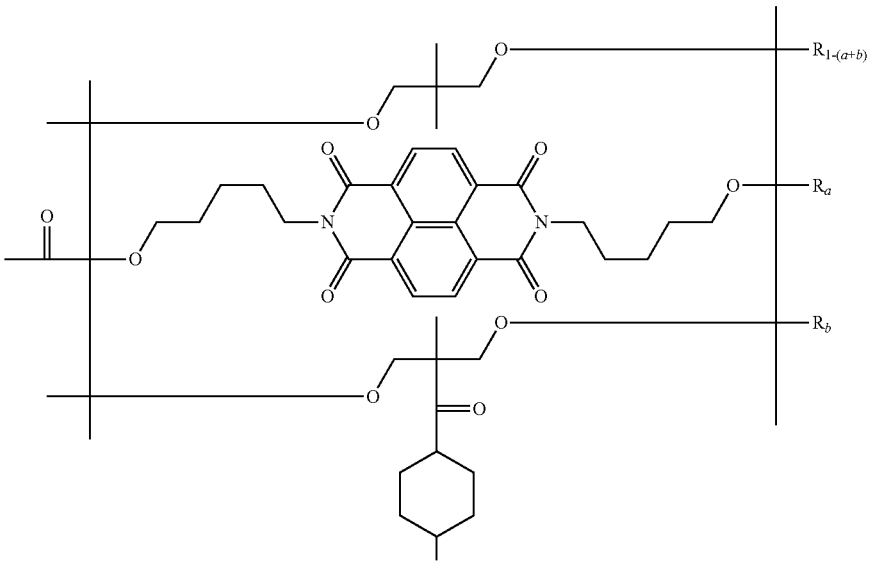
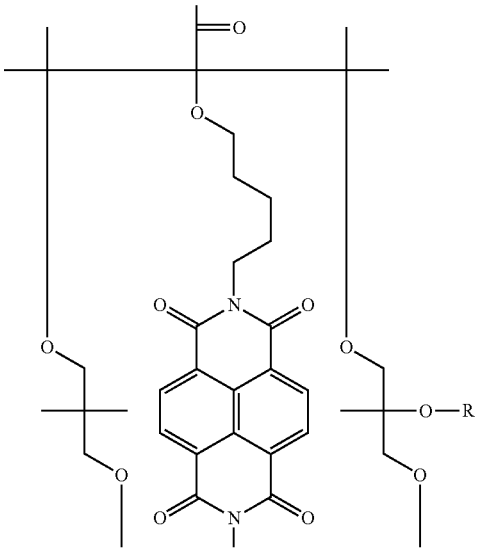

-continued

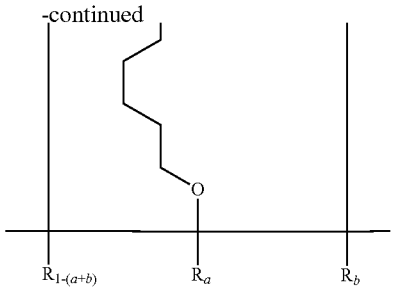

NBpolyester-acrylate

R = H; vinyl; acrylate; methacrylate wherein a value between 0.1 and 0.95 and b represents a value between 0.01 and 0.5 and R represents hydroxy, vinyl, acrylate, or methacrylate end groups Specific structures that incorporate 1,4-cyclohexanedicarboxylic acid, N,N'-Bis-(5-hydroxypentyl)-1,4,5,8-naphthalenetetracarboxylic diimide, 2,2-dimethyl-1,3-propanediol, and pentaerythitol into the polyester-co-imide are shown below.

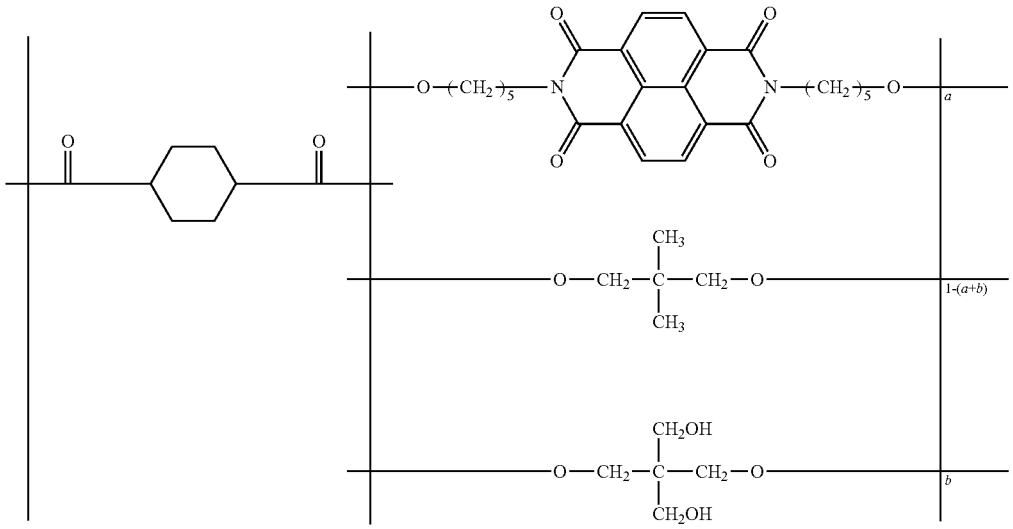

wherein a and b are mole fraction of a group and a represents a value between 0.1 and 0.95 and b represents a value between 0.01 and 0.4. More preferably a represents a value between 0.5 and 0.9 and b represents a value between 0.04 and 0.2.

These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Synthesis of bis(hydroxypentyl)naphthalene bisimide (NB); N,N'-Bis-(5-hydroxypentyl)-1,4,5,8-naphthalenetetracarboxylic diimide A 12L 3 neck round bottom flask was charged with 1,4,5,8-naphthalenetetracarboxylic dianhydride (260 g, 0.97 mol) and water (5800 mL) and stirred at room temperature for 30 minutes before adding 5-amino-1-pentanol (500 g, 4.85 mol) in a slow stream. The mixture was heated on a steam bath at 3 C. until a dark brown burgundy solution formed. The contents were then heated to 60° C. for 5 hours during which a solid phase separated. The contents were cooled to room temperature and the solid was collected by filtration and washed with methanol. The pink-red solid was recrystallized from dimethylformamide to give 300 g of pink solid, melting point of 210-211 C. m/e 438 in the mass spectrum.

$M_n$ and $M_w$ were obtained by size-exclusion chromatography (SEC) in 1,1,1,3,3,3-hexafluoroisopropanol (HFIP) containing 0.01M tetraethylammonium nitrate using two 7.5 mm×300 mm PLgel mixed-C. columns. Polymethylmethacrylate equivalent molecular weight distributions are reported for the samples.

$^{19}F$ NMR Hydroxyl Concentration analysis was performed in replicate, with separate sample preparations. The $^{19}F$ NMR analyses were performed at an observe frequency of 282.821 MHz, ambient temperature, and $CDCl_3$ was the solvent. The samples were derivatized with trifluoroacetylimidazole (TFAI), which converts the hydroxyl groups to fluorinated ester groups. Trifluorotoluene (TFT) was used as an internal reference, thus allowing quantification by $^{19}F$ NMR spectroscopy.

Acid numbers were obtained by dissolving the polymer in 50/1 $MeCl_2$/MeOH and titration to a potentiometric end point with hexadecyltrimethylammonium hydroxide (HDTMAH). The acid number is based on the carboxylic acid end point is 7.1.

Synthesis of NB Polyester Polyol

Copolymerization of 2,2'-dimethyl-1,3-propanediol, N,N'-Bis-(5-hydroxypentyl)-1,4,5,8-naphthalenetetracarboxylic diimide, trimethylolpropane (18/82/16) and 1,4-cyclohexanedicarboxylic acid.

A mixture of 1,4-cylcohexanedicarboxylic acid (CHDA) (96.5 g, 0.560 mol), 2,2'-dimethyl-1,3-propanediol (NPG) (10.50 g, 0.101 mol), trimethylolpropane (TMP) (12.0 g, 0.090 mol), and N,N'-Bis-(5-hydroxypentyl)-1,4,5,8-naphthalenetetracarboxylic diimide (NB5) (201.3 g, 0.459 mol), was charged to a 1 L 3-neck round bottom flask equipped with a Vigreux, vacuum jacketed distillation head and an argon inlet tube. The reaction mixture was placed in a 220° C. salt bath with stirring to produce a transparent, burgundy-colored, homogenous melt. The temperature increased to 275° C. over 4 hours, then a 0.35 schf nitrogen sweep was place through the flask. Clear distillate (25 mL) was collected over the course of the reaction. Stirring was stopped after 10 h, the reaction cooled to room temperature, the polymerization product removed from the reaction vessel and submitted for assay. The glass transition temperature ($T_g$) 77° C., number average molecular weight ($M_n$) 4080, weight average molecular weight ($M_w$) 20100, acid number 2.5 mg KOH/g polymer, and hydroxyl number 0.78 meq/g polymer.

Polymer 1. Acrylation of NB Polyester

A 500-mL three neck round bottom flask with a magnetic stir bar was charged with 20 grams of NB polyester polyol prepared above and 200 grams of dichloromethane (DCM). The mixture was stirred for an hour to become a dark-brown solution. To the solution 1.58 grams of triethyl amine in 13 grams of DCM was added dropwise and stirred for 5 minutes, followed by 1.41 grams of acryloyl chloride in 13 grams of DCM dropwise. The mixture was stirred for an hour at room temperature and then cooled to 0° C. To the mixture 200 grams of DI water was added and stirred for half an hour. The mixture was then precipitated into methanol/ethyl acetate (2/1 vol). The isolated polymer was redissolved into 300 grams of DCM. The DCM solution was extracted by 200 grams of DI water three times. The DCM layer was separated and precipitated into methanol/ethyl acetate. The isolated polymer was dried in a vacuum oven at 70° C. overnight. By NMR, there is no any contamination in the product. Total yield: 17.4 grams; containing 0.49 mmol/g of vinyl group.

Crosslinked Films as Charge Transport Layers

Multilayer photoconductive films comprising a conductive support, a charge injection barrier layer, a charge generation layer (CGL), and a charge transport layer (CTL) are prepared from the following compositions and conditions.

A charge generation layer (CGL) is coated on nickelized poly(ethylene terephthalate) at a dry coverage of 0.05 g/ft$^2$. The CGL mixture comprised 50% of a 75/25 co-crystalline pigment mixture of titanyl pthalocyanine and titanyl tetrafluorophthalocyanine, prepared substantially as described in U.S. Pat. No. 5,614,342 and 50% of a polyester ionomer binder, poly[2,2-dimethyl-1,3-propylene-co-oxydiethylene (80/20) isophthalate-co-5-sodiosulfoisophthalate (95/5)] prepared substantially as described in U.S. Pat. No. 5,733,695. The CGL mixture is prepared at 3 wt % in a 65/35 (wt/wt) mixture of dichloromethane and 1,1,2-trichloroethane, as described in U.S. Pat. No. 5,614,342. A leveling agent, DC510 available from Dow-Corning Company of Midland, Mich. is added at a concentration of 0.019 wt % of the total solution.

Example 1

A mixture of 0.4 grams of Polymer 1, 0.06 grams of CN968 crosslinker from Sartomer Company, Inc.) and 0.04 grams of Esacure One (photoinitiator from Sartomer Company, Inc.) was dissolved in 4.5 grams of DCM at room temperature to make a 10% solution. The solution was coated on nickelized poly(ethylene terephthalate) with a 1 mil coating blade. After dried for 5 minutes at 45° C., the coatings were cured under H-type Ultra-violet (UV) bulb. The energy of the UV source is 725 mJ/cm$^2$ per pass. The coatings were cured at 6 passes under UV radiation.

Comparative Example 1

A photoconductive element is prepared substantially as described in Example 1, except that the coatings were not UV cured. After dried for 5 minutes at 45° C., the coatings were further dried in a 90° C. oven for one hour.

Example 2

A mixture of 0.4 grams of Polymer 1, 0.06 grams of CN968 (crosslinker from Sartomer Company, Inc.) and 0.04 grams of Esacure One (photoinitiator from Sartomer Company, Inc.) was dissolved into 4.5 grams of DCM at room temperature to make a 10% solution. The solution was coated on the charge generation layer prepared as described above with a 1 mil coating blade. After being dried for 5 minutes at 45° C., the coatings were cured under an H-type Ultra-violet (UV) bulb. The energy of the UV source is 725 mJ/cm$^2$ per pass. The coatings were cured at 6 passes under UV radiation.

Comparative Example 2

A photoconductive element is prepared substantially as described in Example 2, except that the coatings were not UV cured. After being dried for 5 minutes at 45° C., the coatings were further dried in a 90° C. oven for one hour.

Example 3

A mixture of 0.4 grams of Polymer 1 and 0.04 grams of Esacure One (photoinitiator from Sartomer Company, Inc.) was dissolved into 3.96 grams of DCM at room temperature to make a 10% solution. The solution was coated on nickelized poly(ethylene terephthalate) with a 1 mil coating blade. After being dried for 5 minutes at 45° C., the coatings were cured under an H-type Ultra-violet (UV) bulb. The energy of the UV source is 725 mJ/cm$^2$ per pass. The coatings were cured at 6 passes under UV radiation.

Comparative Example 3

A photoconductive element is prepared substantially as described in Example 3, except that the coatings were not UV cured. After being dried for 5 minutes at 45° C., the coatings were further dried in a 90° C. oven for one hour.

Example 4

A mixture of 0.4 grams of Polymer 1 and 0.04 grams of Esacure One (photoinitiator from Sartomer Company, Inc.) was dissolved into 3.96 grams of DCM at room temperature to make a 10% solution. The solution was coated on the charge generation layer prepared as described above with a 1 mil coating blade. After being dried for 5 minutes at 45° C., the coatings were cured under an H-type Ultra-violet (UV) bulb. The energy of the UV source is 725 mJ/cm$^2$ per pass. The coatings were cured at 6 passes under UV radiation.

Comparative Example 4

A photoconductive element is prepared substantially as described in Example 4, except that the coatings were not UV cured. After being dried for 5 minutes at 45° C., the coatings were further dried in a 90° C. oven for one hour.

Coated samples of Polymer 1 on nickelized poly(ethylene terephthalate) were extracted with dichloromethane for 3 minutes and the UV/Visible spectrum of the supernatant obtained to determine the amount of material that remained soluble after crosslinking. The absorbance at 350-400 nm was ascribed to the naphthalene bisimide moiety.

The extraction results in Table 1 show that Polymer 1 is crosslinked quickly and efficiently under the predetermined UV curing condition. The amounts of naphthalene bisimide moiety extracted from UV cured materials are relatively low. The UV cured barrier layer prevents contamination of naphthalene bisimide moieties into the other layers of the photoreceptor. The polymer coatings that were oven-dried at 90° C. for 1 hour were still soluble in dichloromethane and had a much larger residual extraction.

The films with Polymer 1 coated on CGL with were corona charged to a positive potential of 100 V and exposed to 740 nm light with an intensity of 1.07 ergs/cm$^2$/sec. The films photodischarged to the residual voltages shown in the table (after 50 ergs/cm$^2$ of exposure). The data in Table 1 demonstrates that in these films the NB Polymer 1 layers are acting as electron transport layers.

TABLE 1

Characterization of UV Cured and Oven Dried NB Polymer 1

| | Extraction of Uncrosslinked Naphthalene Bisimide Moieties from Coating (supernatant absorbance) | | Photodischarge from 100 V Residual Voltage (V) | |
|---|---|---|---|---|
| | UV Cured | Oven Dried | UV Cured | Oven Dried |
| sample# | Example 1 | Comparative Example 1 | Example 2 | Comparative Example 2 |
| Results | 0.09 | 0.34 | 40 | 15 |
| sample# | Example 3 | Comparative Example 3 | Example 4 | Comparative Example 4 |
| Results | 0.01 | 0.44 | 50 | 15 |

Crosslinked Films as Barrier Layers

Multiactive photoconductive films comprising a conductive support, a barrier layer of the photocrosslinkable naphthalene bisimide condensation polymer, a charge generation layer (CGL), and a hole transporting charge transport layer are prepared from the following compositions and conditions.

Example 5

The UV crosslinked NB polymer layer previously coated on nickelized PET in Example 1 was overcoated using a 1 mil coating knife with the CGL solution described above. The samples were dried for 20 min at 80° C. A third layer (CTL) is coated onto the CGL. The CTL mixture comprised 50-wt % Makrolon 5705, 10% poly[4,4'-(norbornylidene) bisphenol terephthalate-co-azelate (60/40)], 20 wt % of 1,1-bis[4-(di-4-tolylamino)phenyl]cyclohexane, and 20 wt % tri-(4-tolyl) amine. The CTL mixture is prepared at 10 wt % in dichloromethane. A coating surfactant, DC510, is added at a concentration of 0.016 wt % of the total mixture. The CTL was then coated with an 8 mil coating knife to give a top layer of approximately 25 microns.

Comparative Example 5

The NB polymer layer previously coated on nickelized PET in Comparative Example 1 was overcoated as described in Example 5.

Example 6

The UV crosslinked NB polymer layer previously coated on nickelized PET in Example 2 was overcoated with CGL and CTL layers as described in Example 5.

Comparative Example 6

The NB polymer layer previously coated on nickelized PET in Comparative Example 2 was overcoated as described in Example 5.

The photoreceptors were corona charged to a surface potential of −500 V and then exposed at 680 nm (1 erg/cm$^2$/sec). The surface potential as a function of time was recorded. The surface potential remaining after a 30 sec exposure is shown in the table below. Table 2 shows that the UV cured naphthalene bisimide polymer can be fabricated into a polymeric barrier layer for an electrophotographic photoreceptor. The photoreceptors displayed good photodischarge characteristics with continuous exposure to low intensity light as described above. The barrier characteristics of the films were evident because without a barrier layer these films do not hold a charge and therefore cannot be corona charged to −500 V. Without any barrier layer there would be very high dark discharge (dark decay) due to hole injection from the Ni electrode.

TABLE 2

| Residual Voltages after Photodischarge from −500 V for NB Barrier Layers | | | | |
|---|---|---|---|---|
| Sample | Example 5 | Comparative Example 5 | Example 6 | Comparative Example 6 |
| Residual Voltage | −84 V | −106 V | −88 V | −89 V |

The invention has been described in detail with particular reference to certain preferred embodiments thereof, but it will be understood that variations and modifications can be effected within the spirit and scope of the invention.

The invention claimed is:

1. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising a photo-initiator, optionally an acrylate crosslinker, and a crosslinkable condensation polymer containing vinyl or acrylic end groups having covalently bonded as repeating units in the polymer chain, aromatic tetracarbonylbisimide groups derived from the formula:

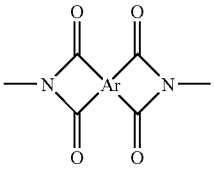

wherein Ar represents a tetravalent aromatic group.

2. The photoconductive element of claim 1 wherein the electrically conductive support comprises aluminum.

3. The photoconductive element of claim 1 wherein the barrier layer has a thickness of between 0.5 and 3 micrometers.

4. The photoconductive element of claim 1 wherein said barrier layer comprises a crosslinker which comprises multifunctional acrylate end groups.

5. The photoconductive element of claim 4 wherein said photo-initiator comprises:

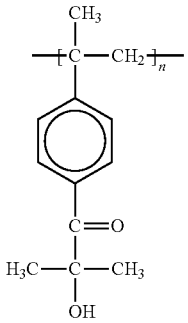

wherein n is 1 or greater.

6. The photoconductive element of claim 1 wherein the electrically conductive support comprises a flexible material having a layer of metal disposed thereon.

7. The photoconductive element of claim 6 wherein the metal is nickel.

8. The photoconductive element of claim 6 wherein the metal is aluminum.

9. The photoconductive element of claim 6 wherein the conductive support is polyethylene terephthalate and the metal is nickel.

10. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising photo-initiator, optionally an acrylate crosslinker, and a condensation polymer containing vinyl or acrylic end groups, which polymer corresponds to a condensation polymer having covalently bonded as repeating units in the polymer chain, aromatic tetracarbonylbisimide groups derived from the formula:

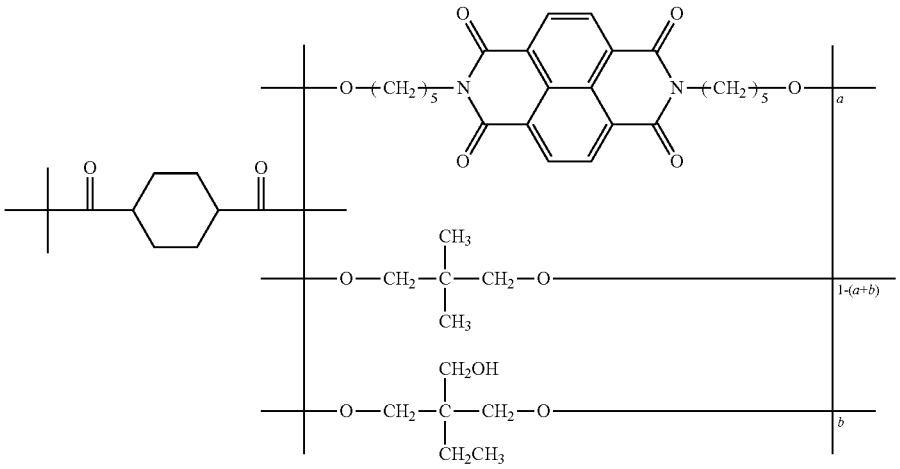

wherein a and b are mole fractions of a group and a represents a value between 0.1 and 0.95 and b represents a value between 0.01 and 0.5.

11. The photoconductive element of claim 10 wherein said polymer was formed at a temperature of between 240 and 270 degrees centigrade and derivatized with acrylate functional groups after dissolving in organic solvents.
12. The photoconductive element of claim 11 wherein said polymer is represented by the formula:
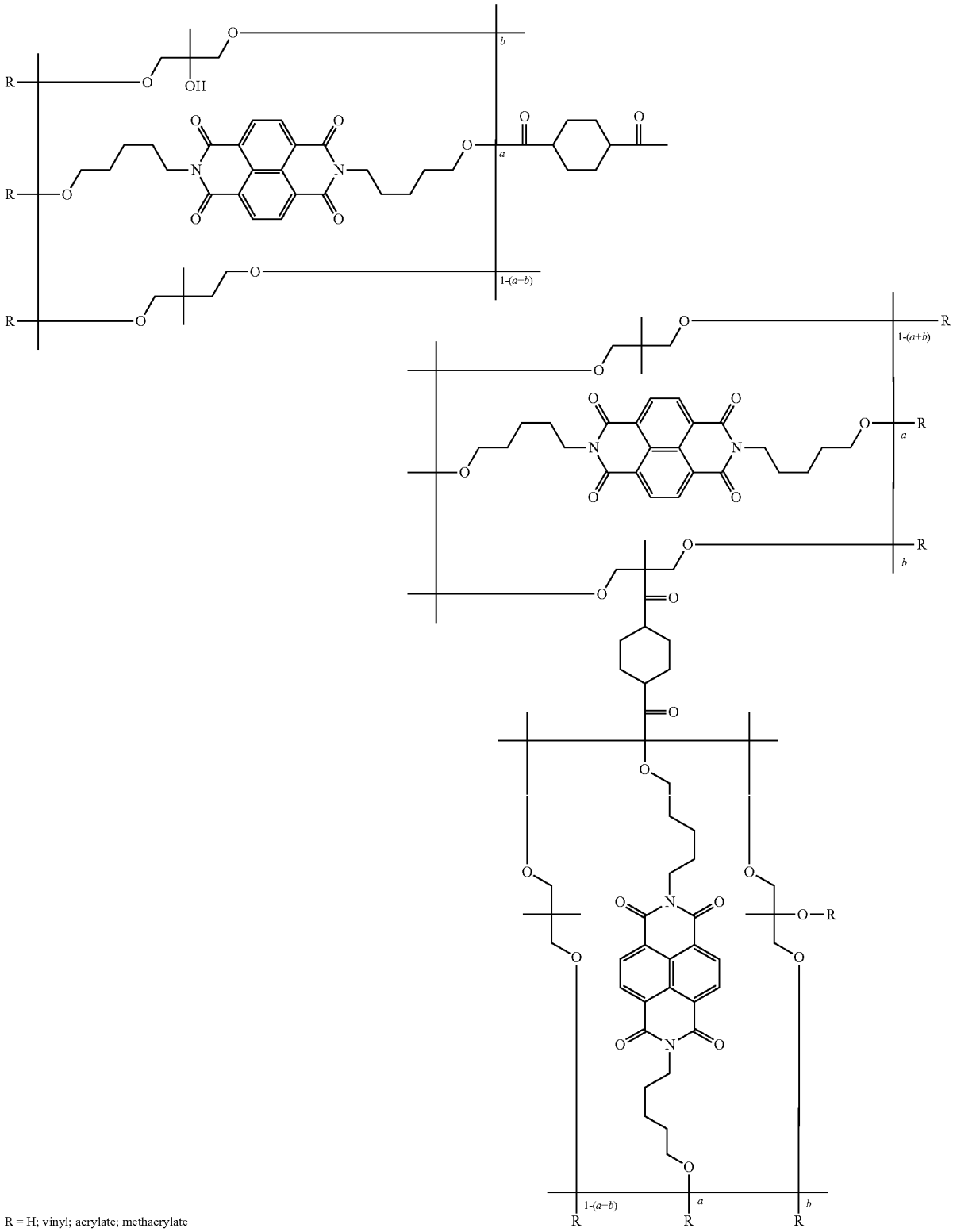
NBpolyester-acrylate wherein a represents a value between 0.1 and 0.95 and b represents a value between 0.01 and 0.5 and R represents H or vinyl, acrylate, or methacrylate end groups.

13. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising a photo-initiator, optionally an acrylate crosslinker, and a condensation polymer containing vinyl or acrylic end groups, which polymer comprises a crosslinkable polyester-co-imide that contains an aromatic tetracarbonylbisimide group derived from the formula:

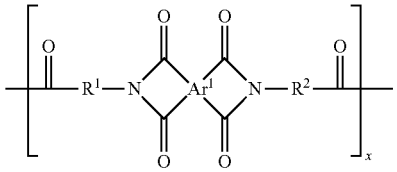

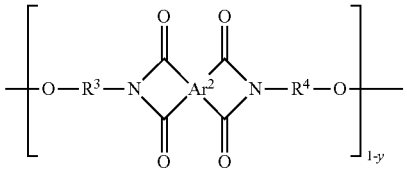

-continued

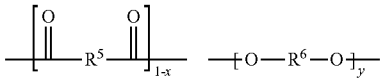

where x is the mole fraction of tetracarbonylbisimide diacid residue in the diacid component of the monomer feed, 1−y is the mole fraction of tetracarbonylbisimide glycol residue in the glycol component of the monomer feed, and such that x+(1−y)=0.1 to 1.9;

$Ar^1$ and $Ar^2$ comprise tetravalent aromatic groups having from 6 to 20 carbon atoms and may be the same or different;

$R^1$, $R^2$, $R^3$, and $R^4$ comprise alkylene and may be the same or different;

$R^5$ comprises alkylene or arylene; and $R^6$ comprises alkylene.

14. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising a photo-initiator, optionally an acrylate crosslinker, and a condensation polymer containing vinyl or acrylic end groups derived from the formula:

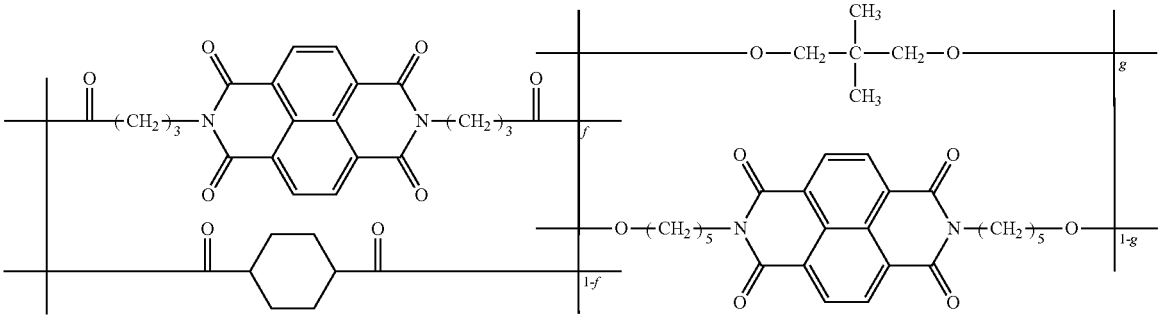

f and g represent mole fractions wherein f is from about 0.1 to 0.9 and g is from 0.1 to about 0.9.

15. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising photo-initiator, optionally an acrylate crosslinker, and a condensation polymer containing vinyl or acrylic end groups, which polymer corresponds to a condensation polymer having covalently bonded as repeating units in the polymer chain, aromatic tetracarbonylbisimide groups derived from the formula:

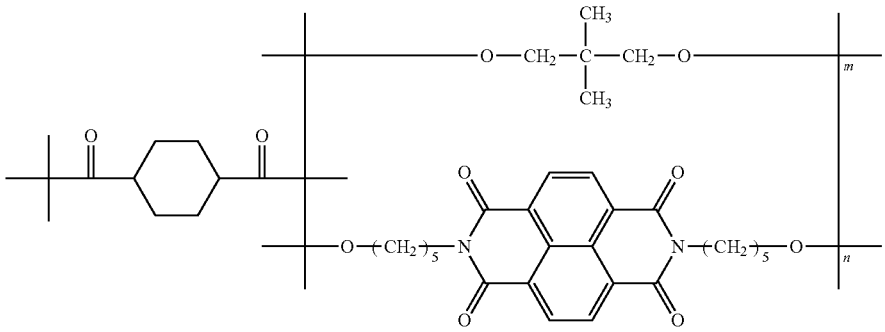

m and n represent mole fractions wherein m is from about 0.1 to 0.9 and n is from 0.1 to about 0.9.

16. A photoconductive element comprising an electrically conductive support, an electrical barrier layer disposed over said electrically conductive support, a charge generation layer capable of generating positive charge carriers when exposed to actinic radiation disposed over said barrier layer, said barrier layer comprising a photo-initiator, optionally an acrylate crosslinker, and a condensation polymer containing vinyl or acrylic end groups, comprising a condensation polymer having covalently bonded as repeating units in the polymer chain, aromatic tetracarbonylbisimide groups derived from the formula:

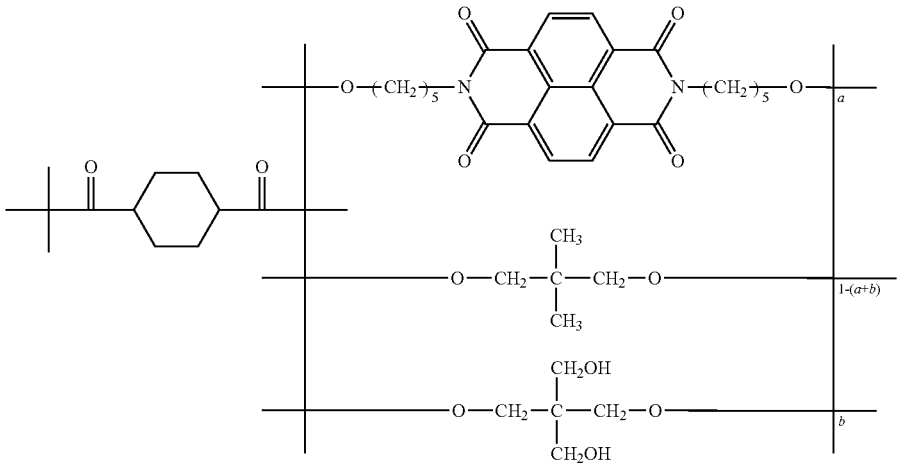

wherein a and b are mole fraction of a group and a represents a value between 0.1 and 0.95 and b represents a value between 0.01 and 0.4.

17. A method of forming an image comprising providing a photoreceptor, charging said photoreceptor, exposing said photoreceptor to actinic radiation, developing said image with a toner, and transferring said image to a receiver sheet, wherein the photoreceptor comprises an electrically conductive support, an electrical barrier layer disposed over said electrically conductive support, a charge generation layer capable of generating positive charge carriers when exposed to actinic radiation disposed over said barrier layer, said barrier layer comprising a photo-initiator, optionally an acrylate crosslinker, and a condensation polymer containing vinyl or acrylic end groups covalently bonded as repeating units in the polymer chain, aromatic tetracarbonylbisimide groups derived from the formula:

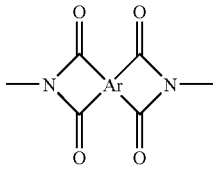

wherein Ar represents a tetravalent aromatic group.

18. A method of forming an image comprising providing a photoreceptor, charging said photoreceptor, exposing said photoreceptor to actinic radiation, developing said image with a toner, and transferring said image to a receiver sheet, wherein the photoreceptor comprises an electrically conductive support, an electrical barrier layer disposed over said electrically conductive support, a charge generation layer capable of generating positive charge carriers when exposed to actinic radiation disposed over said barrier layer, said barrier layer comprising a photo-initiator, an optional acrylate, and a condensation polymer containing vinyl or acrylic end groups comprising a crosslinkable polyester-co-imide that contains an aromatic tetracarbonylbisimide group derived from the formula:

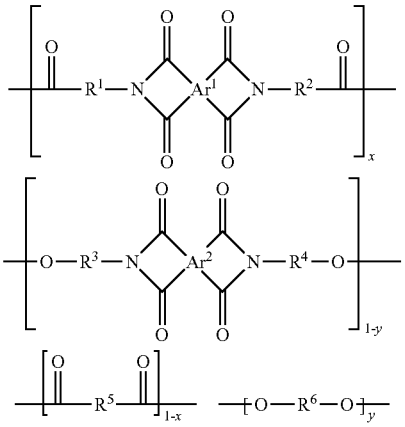

where x is the mole fraction of tetracarbonylbisimide diacid residue in the diacid component of the monomer feed, 1−y is the mole fraction of tetracarbonylbisimide glycol residue in the glycol component of the monomer feed, and such that x+(1−y)=0.1 to 1.9;

$Ar^1$ and $Ar^2$ comprise tetravalent aromatic groups having from 6 to 20 carbon atoms and may be the same or different;

$R^1$, $R^2$, $R^3$, and $R^4$ comprises alkylene and may be the same or different, $R^5$ comprises alkylene or arylene; and $R^6$ comprises alkylene.

* * * * *